US009653888B2

(12) United States Patent
Yokoyama et al.

(10) Patent No.: US 9,653,888 B2
(45) Date of Patent: May 16, 2017

(54) SPARK PLUG

(71) Applicant: NGK SPARK PLUG CO., LTD., Nagoya-shi, Aichi (JP)

(72) Inventors: Yutaka Yokoyama, Kasugai (JP); Kuniharu Tanaka, Komaki (JP); Katsuya Takaoka, Ichinomiya (JP); Shun Kondo, Obu (JP); Nobuyoshi Araki, Nagoya (JP); Toshiki Kon, Komaki (JP); Haruki Yoshida, Tajimi (JP); Jumpei Isasa, Aichi (JP); Hirokazu Kurono, Nagoya (JP); Hironori Uegaki, Nagoya (JP); Toshimasa Saji, Konan (JP); Yusuke Nomura, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/272,807

(22) Filed: Sep. 22, 2016

(65) Prior Publication Data

US 2017/0093134 A1 Mar. 30, 2017

(30) Foreign Application Priority Data

Sep. 24, 2015 (JP) ..... 2015-186377

(51) Int. Cl.
*H01T 13/38* (2006.01)

(52) U.S. Cl.
CPC ..... *H01T 13/38* (2013.01)

(58) Field of Classification Search
CPC ..... H01T 13/38; H01T 13/00; H01T 13/04; H01T 13/40; H01T 13/44; H01T 13/06; F02P 13/00; F02P 3/02
See application file for complete search history.

(56) References Cited

U.S. PATENT DOCUMENTS

| | | | | |
|---|---|---|---|---|
| 2001/0004184 | A1 | 6/2001 | Ito et al. | 313/143 |
| 2010/0136867 | A1 | 6/2010 | Kurono et al. | 445/7 |
| 2014/0243184 | A1 | 8/2014 | Fujimura et al. | 501/32 |

FOREIGN PATENT DOCUMENTS

| | | | |
|---|---|---|---|
| JP | 2000-313657 A | 11/2000 | C04B 35/111 |
| JP | 2001-155546 A | 6/2001 | F02P 13/00 |

(Continued)

*Primary Examiner* — Donald Raleigh
*Assistant Examiner* — Jose M Diaz
(74) *Attorney, Agent, or Firm* — Kusner & Jaffe

(57) ABSTRACT

A spark plug including an insulator containing not less than 92 mass % and not greater than 96 mass % of Al component in terms of oxide, wherein the insulator is formed from an alumina sintered body comprising alumina crystal and a grain boundary phase present between crystal grains of the alumina crystal. Assuming that mass contents of an Si component, an Mg component, a Ba component, and a Ca component in terms of oxide are represented by $M_{SiO2}$, $M_{MgO}$, $M_{BaO}$, and $M_{CaO}$, respectively, and a sum of $M_{SiO2}$, $M_{MgO}$, $M_{BaO}$, and $M_{CaO}$ is represented by Mt, the grain boundary phase contains these components so as to satisfy conditions (1) to (4) as follows: (1) $0.17 \leq M_{SiO2}/Mt \leq 0.47$; (2) $0.005 \leq M_{MgO}/Mt \leq 0.07$; (3) $0.29 \leq M_{BaO}/Mt \leq 0.77$; (4) $0.03 \leq M_{CaO}/Mt \leq 0.19$.

4 Claims, 2 Drawing Sheets

(56) References Cited

FOREIGN PATENT DOCUMENTS

| | | | | |
|---|---|---|---|---|
| JP | WO 2009/119098 | A1 | 1/2009 | ..... H01T 13/38 |
| JP | 2014-187004 | A | 10/2014 | ..... C04B 35/111 |

SPARK PLUG

RELATED APPLICATIONS

This application claims the benefit of Japanese Patent Application No. 2015-186377, filed Sep. 24, 2015, the entire contents of which is incorporated herein by reference.

FIELD OF THE INVENTION

The present invention relates to a spark plug. In particular, the present invention relates to a spark plug including an insulator having excellent withstand voltage performance under a high temperature environment.

BACKGROUND OF THE INVENTION

Spark plugs for use in internal combustion engines such as automobile engines each have a spark plug insulator (also referred to simply as "insulator") formed from, for example, an alumina-based sintered material containing alumina ($Al_2O_3$) as a principal component. This insulator is formed from such an alumina-based sintered material because the alumina-based sintered material is excellent in heat resistance, mechanical strength, and the like. In order to obtain such an alumina-based sintered material, for example, a three-component sintering aid composed of, for example, silicon oxide ($SiO_2$), calcium monoxide (CaO), and magnesium monoxide (MgO) has been used for the purpose of lowering the firing temperature and improving sinterability.

The temperature in a combustion chamber of an internal combustion engine to which such a spark plug is attached sometimes reaches about 700° C., for example. Therefore, the spark plug is required to exert excellent withstand voltage performance in a temperature range from the room temperature to about 700° C. Alumina-based sintered materials have been proposed which are suitably used for insulators or the like of spark plugs exerting the withstand voltage performance.

For example, Japanese Patent Application Laid-Open (kokai) No. 2001-155546 discloses " . . . an insulator for a spark plug, which comprises an alumina-based sintered body comprising: $Al_2O_3$ (alumina) as a main component; and at least one component (hereinafter referred to as "E. component") selected from the group consisting of Ca (calcium) component, Sr (strontium) component and Ba (barium) component, wherein at least part of the alumina-based sintered body comprises particles comprising a compound comprising the E. component and Al (aluminum) component, the compound having a molar ratio of the Al component to the E. component of 4.5 to 6.7 as calculated in terms of oxides thereof, and has a relative density of 90% or more." (see claim 1 of Japanese Patent Application Laid-Open (kokai) No. 2001-155546). Japanese Patent Application Laid-Open (kokai) No. 2001-155546 indicates that this technique can provide a spark plug having an insulator which is less liable to occurrence of dielectric breakdown due to the effect of residual pores or low-melting glass phases present on boundaries of the alumina-based sintered body, and exhibits a higher dielectric strength at a temperature as high as around 700° C. than the conventional materials (see, for example, paragraph Japanese Patent Application Laid-Open (kokai) No. 2001-155546).

Meanwhile, International Publication No. 2009/119098, for the purpose of providing a spark plug having an insulator that exerts high withstand voltage characteristics and high-temperature strength (see paragraph [0014] of International Publication No. 2009/119098), discloses "A spark plug . . . the insulator is formed from a dense alumina-based sintered material having a mean crystal grain size $D_A$ (Al) of 1.50 μm or more; the alumina-based sintered material contains an Si component and, among group 2 elements (the Group included in the periodic table defined by Recommendations 1990, IUPAC), Mg and Ba, as essential components, and a group 2 element (2A) component containing at least one element other than Mg and Ba, and a rare earth element (RE) component, wherein the ratio of the Si component content S (oxide-reduced mass %) to the sum (S+A) of S and the group 2 element (2A) component content A (oxide-reduced mass %) is 0.60 or higher" (see claim 1 of International Publication No. 2009/119098).

Japanese Patent Application Laid-Open (kokai) 2014-187004, for the purpose of improving the strength and the withstand voltage performance, discloses "an insulator . . . wherein a ratio between a content of a rare earth element in terms of oxide and expressed in percent by mass and a content of a group 2 element (included in the periodic table defined by Recommendations 1990, IUPAC) in terms of oxide and expressed in percent by mass, satisfies 0.1≤content of rare earth element/content of group 2 element ≤1.4, and a ratio between the content of the rare earth element and a content of barium oxide in terms of oxide and expressed in percent by mass, satisfies 0.2≤content of barium oxide/content of rare earth element ≤0.8, wherein at least one virtual rectangular frame of 7.5 μm×50 μm that encloses a crystal containing the rare earth element is present in an arbitrary region of 630 μm×480 μm at a cross section of the sintered body, and an occupation ratio of an area of the crystal containing the rare earth element to an area of the rectangular frame is 5% or more, and when the rectangular frame is divided into three division regions in a direction of a long side thereof, among occupation ratios of areas of the crystal containing the rare earth element in the respective division regions, a ratio between the occupation ratio of the maximum area and the occupation ratio of the minimum area is 5.5 or less" (see claim 1 of Japanese Patent Application Laid-Open (kokai) 2014-187004).

Japanese Patent Application Laid-Open (kokai) 2000-313657 discloses "a high withstand voltage alumina-based sintered body containing at least one component (hereinafter referred to as "E. component") selected from the group consisting of Ca (calcium) component, Sr (strontium) component, and Ba (barium) component, wherein particles containing the E. component and Al (aluminum) component are present in at least a part of the alumina-based sintered body, the particles contain a compound in which a molar ratio of the Al component (in terms of $Al_2O_3$) in terms of oxide, to the E. component (E. in terms of O) in terms of oxide is in a range of 4.5 to 6.7, and the alumina-based sintered body has a relative density of 90% or more" (see claim 1 of Japanese Patent Application Laid-Open (kokai) 2000-313657). Japanese Patent Application Laid-Open (kokai) 2000-313657 indicates that this technique can realize sufficient withstand voltage characteristics in a wide temperature range from a temperature not higher than room temperature to a high temperature near 700° C. (see, for example, paragraph [0015] of Japanese Patent Application Laid-Open (kokai) 2000-313657).

In recent years, the temperature in the combustion chamber tends to be increased for high output and improved fuel efficiency of the internal combustion engine. With this, the insulator as a component of the spark plug may be exposed to a higher temperature than before, for example, about 900° C. Therefore, an insulator is desired which has excellent withstand voltage performance under a high temperature environment of about 900° C. In the techniques disclosed in Japanese Patent Application Laid-Open (kokai) No. 2001-155546, International Publication No. 2009/119098, Japanese Patent Application Laid-Open (kokai) 2014-187004 and Japanese Patent Application Laid-Open (kokai) 2000-313657 described above, it is not assumed that the insulator is exposed to such a high temperature of about 900° C. Therefore, the insulators disclosed in Japanese Patent Application Laid-Open (kokai) No. 2001-155546, International Publication No. 2009/119098, Japanese Patent Application Laid-Open (kokai) 2014-187004 and Japanese Patent Application Laid-Open (kokai) 2000-313657 described above cannot achieve a sufficient level of withstand voltage performance under a high temperature environment of about 900° C.

An advantage of the present invention is a spark plug that includes an insulator having excellent withstand voltage performance under a high temperature environment.

SUMMARY OF THE INVENTION

Means for solving the above problems is

[1] In accordance with a first aspect of the present invention, there is provided a spark plug including an insulator that contains not less than 92 mass % and not greater than 96 mass % of Al component in terms of oxide, wherein the insulator is formed from an alumina sintered body comprising an alumina crystal and a grain boundary phase present between crystal grains of the alumina crystal, and assuming that mass contents of Si component, Mg component, Ba component, and Ca component in terms of oxide are represented by $M_{SiO2}$, $M_{MgO}$, $M_{BaO}$, and $M_{CaO}$, respectively, and a sum of $M_{SiO2}$, $M_{MgO}$, $M_{BaO}$, and $M_{CaO}$ is represented by Mt, the grain boundary phase contains the Si component, the Mg component, the Ba component, and the Ca component so as to satisfy conditions (1) to (4) as follows:

$$0.17 \leq M_{SiO2}/Mt \leq 0.47 \quad (1)$$

$$0.005 \leq M_{MgO}/Mt \leq 0.07 \quad (2)$$

$$0.29 \leq M_{BaO}/Mt \leq 0.77 \quad (3)$$

$$0.03 \leq M_{CaO}/Mt \leq 0.19 \quad (4)$$

[2] In accordance with a second aspect of the present invention, there is provided a spark plug as described above, wherein the grain boundary phase has a hexagonal-system crystal phase that contains at least the Ba component and the Al component.

[3] In accordance with a third aspect of the present invention, there is provided a spark plug according to the above [1] or [2], wherein the grain boundary phase has a crystal phase that contains the Si component and at least one of components of group 2 elements included in a periodic table defined by Recommendations 1990, IUPAC.

The spark plug according to the present invention includes the insulator that contains not less than 92 mass % and not greater than 96 mass % of Al component in terms of oxide, and is formed from the alumina sintered body comprising the alumina crystal and the grain boundary phase. The grain boundary phase contains the Si component, the Mg component, the Ba component, and the Ca component so as to satisfy the above conditions (1) to (4). Therefore, the spark plug has sufficient withstand voltage performance when it is used under an environment in which, for example, the insulator is exposed to a high temperature, for example, about 900° C. Therefore, according to the present invention, it is possible to provide a spark plug including an insulator having excellent withstand voltage performance under a high temperature environment.

DETAILED DESCRIPTION OF THE PREFERRED EMBODIMENTS

Figure 1:
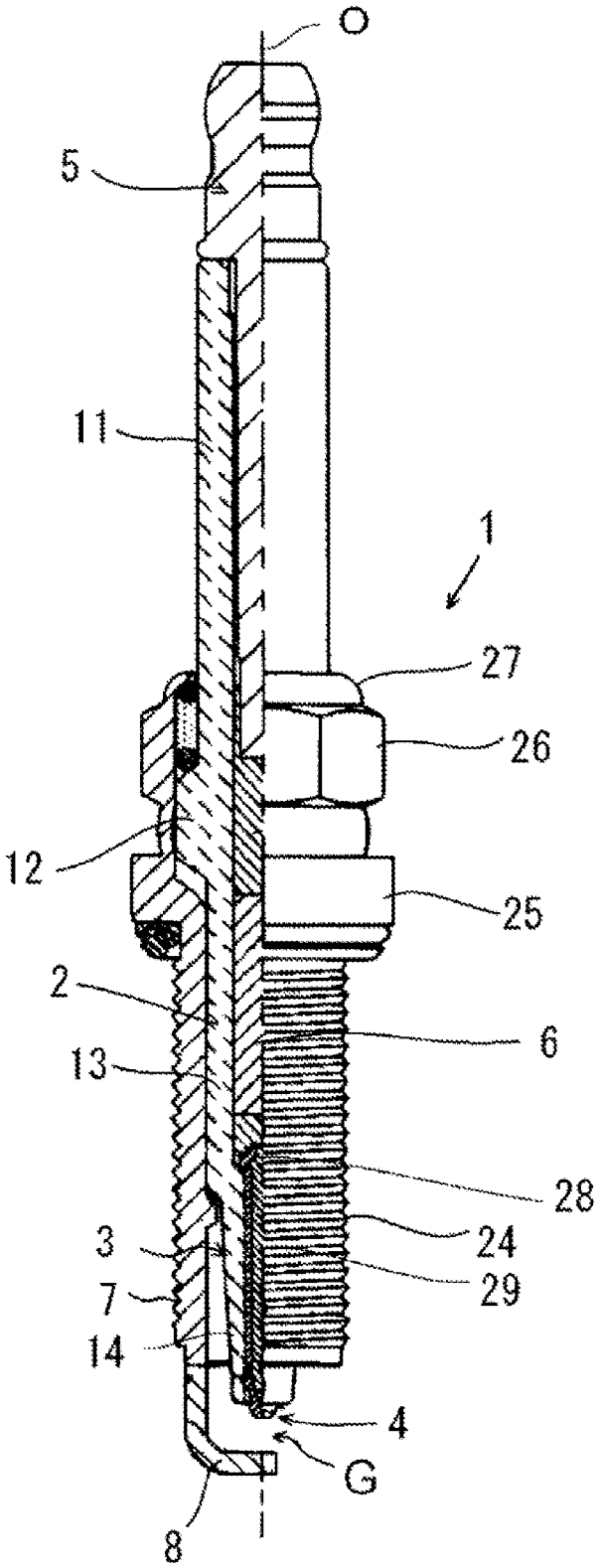
FIG. 1 is a partially sectional explanatory view of a spark plug which is one embodiment of a spark plug according to the present invention.

A spark plug which is one embodiment of a spark plug according to the present invention is shown in FIG. 1. FIG. 1 is a partially sectional explanatory view of a spark plug 1 which is one embodiment of a spark plug according to the present invention. In FIG. 1, the downward direction on the sheet, i.e., the direction toward the side at which a later-described ground electrode is disposed, is a frontward direction along an axis O, and the upward direction on the sheet is a rearward direction along the axis O.

As shown in FIG. 1, this spark plug 1 includes: a substantially cylindrical insulator 3 having an axial bore 2 that extends in the direction of the axis O; a substantially rod-shaped center electrode 4 provided at the front side in the axial bore 2; a metal terminal 5 provided at the rear side in the axial bore 2; a connection portion 6 disposed between the center electrode 4 and the metal terminal 5 in the axial bore 2; a substantially cylindrical metallic shell 7 provided on the outer periphery of the insulator 3; and a ground electrode 8 having a base end portion fixed to a front end of the metallic shell 7, and a front end portion opposed to the center electrode 4 via a gap G.

The insulator 3 has the axial bore 2 extending in the direction of the axis O, and has a substantially cylindrical shape. The insulator 3 includes a rear trunk portion 11, a large diameter portion 12, a front trunk portion 13, and a leg portion 14. The rear trunk portion 11 houses the metal terminal 5, and insulates the metal terminal 5 and the metallic shell 7 from each other. The large diameter portion 12 is disposed on the front side relative to the rear trunk portion 11, and projects radially outward. The front trunk portion 13 is disposed on the front side relative to the large diameter portion 12, has an outer diameter smaller than that of the large diameter portion 12, and houses the connection portion 6. The leg portion 14 is disposed on the front side relative to the front trunk portion 13, has an outer diameter and an inner diameter smaller than those of the front trunk portion 13, and houses the center electrode 4. The insulator 3 is fixed to the metallic shell 7, with an end portion, in the frontward direction, of the insulator 3 projecting from a front end face of the metallic shell 7. The insulator 3 is formed from a material having mechanical strength, thermal strength, and electrical insulation property. The insulator 3, which is a feature of the present invention, will be described later in detail.

The connection portion 6 is disposed between the center electrode 4 and the metal terminal 5 in the axial bore 2. The connection portion 6 fixes the center electrode 4 and the metal terminal 5 in the axial bore 2, and electrically connects therebetween.

The metallic shell 7 has a substantially cylindrical shape, and is formed such that the metallic shell 7 holds the insulator 3 when the insulator 3 is inserted therein. The metallic shell 7 has a screw portion 24 formed on an outer peripheral surface thereof in the frontward direction. The screw portion 24 is used for mounting the spark plug 1 to a cylinder head of an internal combustion engine which is not shown. The metallic shell 7 has a flange-shaped gas seal portion 25 at the rear side of the screw portion 24, and has a tool engagement portion 26 for engaging a tool such as a spanner or a wrench at the rear side of the gas seal portion 25, and a crimping portion 27 at the rear side of the tool engagement portion 26. The front end portion of the inner peripheral surface of the screw portion 24 is disposed so as to form a space with respect to the leg portion 14. The metallic shell 7 may be formed from a conductive steel material such as low-carbon steel.

The metal terminal 5 is a terminal for applying a voltage from the outside to the center electrode 4 so as to cause spark discharge between the center electrode 4 and the ground electrode 8. The metal terminal 5 is inserted into the axial bore 2 and fixed by the connection portion 6, with a part thereof being exposed from the rear end side of the insulator 3. The metal terminal 5 may be formed from a metal material such as low-carbon steel.

The center electrode 4 has a rear end portion 28 in contact with the connection portion 6, and a rod-shaped portion 29 extending toward the front side from the rear end portion 28. The center electrode 4 is fixed in the axial bore 2 of the insulator 3, with a front end thereof projecting from the front end of the insulator 3, whereby the center electrode 4 is insulated from and held by the metallic shell 7. The rear end portion 28 and the rod-shaped portion 29 of the center electrode 4 may be formed from a known material used for the center electrode 4, such as an Ni alloy. The center electrode 4 may be formed by an outer layer formed from an Ni alloy or the like, and a core portion that is formed from a material having a higher coefficient of thermal conductivity than the Ni alloy, and formed so as to be concentrically embedded in an axial portion within the outer layer. Examples of such a material of the core portion may include Cu, a Cu alloy, Ag, an Ag alloy, and pure Ni.

The ground electrode 8 is formed into, for example, a substantially prismatic shape. Specifically, the ground electrode 8 is formed such that the base end portion is joined to the front end portion of the metallic shell 7, an intermediate portion thereof is bent in a substantially L shape, and the front end portion is opposed to a front end of the center electrode 4 with a gap G therebetween. In the present embodiment, the gap G represents the shortest distance between the front end of the center electrode 4 and the side surface of the ground electrode 8. The gap G is usually set to be 0.3 to 1.5 mm. The ground electrode 8 may be formed from a known material used for the ground electrode 8, such as an Ni alloy. Like the center electrode 4, the ground electrode 8 may be composed of an outer layer formed from an Ni alloy or the like, and a core portion that is formed from a material having a higher coefficient of thermal conductivity than the Ni alloy, and formed so as to be concentrically embedded in an axial portion within the outer layer.

Hereinafter, the insulator, which is a feature of the present invention, will be described in detail.

The insulator 3 is formed from an alumina sintered body that contains not less than 92 mass % and not greater than 96 mass % of Al component in terms of oxide, to the total mass of components, in terms of oxides, contained in the insulator 3. The alumina sintered body is composed of alumina crystal, and a grain boundary phase present between crystal grains of the alumina crystal. Most of the Al component is present as the alumina crystal in the alumina sintered body. Part of the Al component is present in a glass phase and a crystal phase that are present in the grain boundary phase. The alumina sintered body is excellent in withstand voltage performance, mechanical strength, and the like when the content of the Al component in terms of oxide is within the above-mentioned range. When the content of the Al component in terms of oxide exceeds 96 mass %, sinterability is degraded, and voids are likely to remain in the alumina sintered body. In this case, sufficient withstand voltage performance cannot be obtained. When the content of the Al component in terms of oxide is less than 92 mass %, the ratio of the glass phase in the grain boundary phase relatively increases. In this case, if the glass phase is softened at a high temperature, for example, about 900° C., sufficient withstand voltage performance cannot be obtained.

Assuming that the mass contents of an Si component, an Mg component, a Ba component, and a Ca component in terms of oxides are represented by $M_{SiO2}$, $M_{MgO}$, $M_{BaO}$, and $M_{CaO}$, respectively, and the sum of $M_{SiO2}$, $M_{MgO}$, $M_{BaO}$, and $M_{CaO}$ is represented by Mt, the grain boundary phase contains the Si component, the Mg component, the Ba component, and the Ca component so as to satisfy conditions (1) to (4) as follows:

$$0.17 \leq M_{SiO2}/Mt \leq 0.47 \quad (1)$$

$$0.005 \leq M_{MgO}/Mt \leq 0.07 \quad (2)$$

$$0.29 \leq M_{BaO}/Mt \leq 0.77 \quad (3)$$

$$0.03 \leq M_{CaO}/Mt \leq 0.19 \quad (4)$$

The content of the Al component in the alumina sintered body is within the above-mentioned range, and the grain boundary phase contains the Si component, the Mg component, the Ba component, and the Ca component so as to satisfy the above conditions (1) to (4). Therefore, when the spark plug 1 is used under an environment in which the insulator 3 formed from the alumina sintered body is exposed to a high temperature, for example, about 900° C., the insulator 3 has sufficient withstand voltage performance. Therefore, according to the present invention, it is possible to provide a spark plug including an insulator having excellent withstand voltage performance under a high temperature environment.

The Si component is present in the alumina sintered body in the form of oxide, ion, or the like. The Si component melts during sintering to usually form a liquid phase, and therefore serves as a sintering aid which promotes densification of the alumina sintered body. After completion of sintering, the Si component is present, in the grain boundary phase, as a glass phase or as a crystal phase together with another element such as Al. In the grain boundary phase, the mass ratio $M_{SiO2}/Mt$ of the Si component is not less than 0.17, and preferably not less than 0.19. The mass ratio $M_{SiO2}/Mt$ is not greater than 0.47, preferably not greater than 0.45, and more preferably not greater than 0.40. In the grain boundary phase, if the content of the Si component is small and the mass ratio $M_{SiO2}/Mt$ is less than 0.17, sinterability is degraded, which makes it difficult to obtain a dense alumina sintered body. Consequently, sufficient withstand voltage performance cannot be obtained. In the grain boundary phase, if the content of the Si component is great and the mass ratio $M_{SiO2}$/Mt is greater than 0.47, the ratio of the glass phase in the grain boundary phase increases. Therefore, if the glass phase is softened at a high temperature, for example, about 900° C., sufficient withstand voltage performance cannot be obtained.

The Mg component is present in the alumina sintered body in the form of oxide, ion, or the like. The Mg component melts during sintering to usually form a liquid phase, and therefore serves as a sintering aid which promotes densification of the alumina sintered body. After completion of sintering, the Mg component is present, in the grain boundary phase, as a glass phase or as a crystal phase together with another element such as Al. In the grain boundary phase, the mass ratio $M_{MgO}$/Mt of the Mg component is not less than 0.005, and preferably not less than 0.015. The mass ratio $M_{MgO}$/Mt is not greater than 0.07, and preferably not greater than 0.041. In the grain boundary phase, if the content of the Mg component is small and the mass ratio $M_{MgO}$/Mt is less than 0.005, anomalous grain growth of the alumina crystal is likely to occur, whereby bending strength is degraded. In the grain boundary phase, if the content of the Mg component is great and the mass ratio $M_{MgO}$/Mt is greater than 0.07, sufficient withstand voltage performance cannot be obtained at a high temperature, for example, about 900° C.

The Ba component is present in the alumina sintered body in the form of oxide, ion, or the like. The Ba component melts during sintering to usually form a liquid phase, and therefore serves as a sintering aid which promotes densification of the alumina sintered body. After completion of sintering, the Ba component is present, in the grain boundary phase, as a glass phase or as a crystal phase together with another element such as Al. In the grain boundary phase, the mass ratio $M_{BaO}$/Mt of the Ba component is not less than 0.29, and preferably not less than 0.35, and more preferably not less than 0.45. The mass ratio $M_{BaO}$/Mt is not greater than 0.77, and preferably not greater than 0.71. In the grain boundary phase, if the content of the Ba component is small and the mass ratio $M_{BaO}$/Mt is less than 0.29, deposition of the crystal phase in the grain boundary phase is difficult, and sufficient withstand voltage performance cannot be obtained at a high temperature, for example, about 900° C. In the grain boundary phase, if the content of the Ba component is great and the mass ratio $M_{BaO}$/Mt is greater than 0.77, sinterability is degraded, which makes it difficult to obtain a dense alumina sintered body. Consequently, sufficient withstand voltage performance cannot be obtained. Preferably, the content of the Ba component is greater than the contents of the Mg component and the Ca component, and more preferably is greater than the contents of the Si component, the Mg component, and the Ca component. When the content of the Ba component is relatively great as compared to the contents of the other sintering aids, deposition of the crystal phase in the grain boundary phase is facilitated, whereby the withstand voltage performance at a high temperature, for example about 900° C., is further improved.

The Ca component is present in the alumina sintered body in the form of oxide, ion, or the like. The Ca component melts during sintering to usually form a liquid phase, and therefore serves as a sintering aid which promotes densification of the alumina sintered body. After completion of sintering, the Ca component is present, in the grain boundary phase, as a glass phase or as a crystal phase together with another element such as Al. In the grain boundary phase, the mass ratio $M_{CaO}$/Mt of the Ca component is not less than 0.03. The mass ratio $M_{CaO}$/Mt is not greater than 0.19, and preferably not greater than 0.10. In the grain boundary phase, if the content of the Ca component is small and the mass ratio $M_{CaO}$/Mt is less than 0.03, sinterability is degraded, which makes it difficult to obtain a dense alumina sintered body. Consequently, sufficient withstand voltage performance cannot be obtained. In the grain boundary phase, if the content of the Ca component is great and the mass ratio $M_{CaO}$/Mt is greater than 0.19, deposition of the crystal phase in the grain boundary phase is difficult, and sufficient withstand voltage performance cannot be obtained at a high temperature, for example, about 900° C.

The alumina sintered body may contain components (hereinafter also referred to as group 2 element components) of group 2 elements, other than the Ba component, the Mg component, and the Ca component, which elements are included in the periodic table defined by Recommendations 1990, IUPAC. Examples of the group 2 element components other than the Ba component, the Mg component, and the Ca component may include an Sr component from the viewpoint of low toxicity. In the case where the Sr component is present in the alumina sintered body, the Sr component is present in the alumina sintered body in the form of oxide, ion, or the like, similarly to the Ba component, the Mg component, and the Ca component. The Sr component melts during sintering to usually form a liquid phase, and therefore serves as a sintering aid which promotes densification of the alumina sintered body. After completion of sintering, the Sr component is present, in the grain boundary phase, as a glass phase or as a crystal phase together with another element such as Al.

The grain boundary phase preferably has, as a crystal phase, at least one of hexagonal-system crystal phases containing at least a Ba component and an Al component. When the grain boundary phase has the hexagonal-system crystal phase containing at least the Ba component and the Al component, withstand voltage performance at a high temperature, for example about 900° C., is further improved. In the alumina sintered body, when the glass phase in the grain boundary phase is softened at such a high temperature, the softened glass phase serves as a conductive path, whereby withstand voltage performance is degraded. On the other hand, when the hexagonal-system crystal phase containing at least the Ba component and the Al component is present in the grain boundary phase, since this crystal phase is a plate-shaped crystal phase having a maximum length of about 0.2 to 3 μm, the crystal phase sections the conductive path, whereby withstand voltage performance under a high temperature environment is improved. Examples of the hexagonal-system crystal phase containing at least the Ba component and the Al component may include: a hexagonal-system crystal phase containing the Ba component and the Al component; and a hexagonal-system crystal phase containing the Ba component, the Al component, and the Mg component. Examples of the hexagonal-system crystal phase containing the Ba component and the Al component may include $BaAl_{12}O_{19}$, $Ba_{0.717}Al_{11}O_{17.282}$, $Ba_{0.75}Al_{11}O_{17.25}$, $Ba_{0.79}Al_{10.9}O_{17.14}$, $Ba_{0.83}Al_{11}O_{17.33}$, $Ba_{0.857}Al_{10.914}O_{17.232}$, $BaAl_{13.2}O_{20.8}$, $Ba_{1.157}Al_{10.686}O_{17.157}$, $Ba_{1.17}Al_{10.67}O_{17.2}$, $Ba_2Al_{10}O_{17}$, and $Ba_{2.333}Al_{21.333}O_{34.333}$. Examples of the hexagonal-system crystal phase containing the Ba component, the Al component, and the Mg component may include $BaMgAl_{10}O_{17}$, $Ba_{0.638}Mg_{0.276}Al_{10.724}O_{17}$, $Ba_{0.82}Mg_{0.63}Al_{10.37}O_{17}$, $Ba_{0.62}Mg_{0.67}Al_{10.33}O_{17}$, and $Ba_{0.956}Mg_{0.912}Al_{10.088}O_{17}$. Similar effects to those achieved by the hexagonal-system crystal phase containing at least the Ba component and the Al component can be achieved by a hexagonal-system crystal phase containing at least a Ca component and an Al component, and a hexagonal-system crystal phase containing at least an Sr component and an Al component.

The grain boundary phase preferably has, as a crystal phase, at least one of crystal phases that contain at least an Si component and at least one of the group 2 element components. Examples of the group 2 element components contained in the crystal phases may include an Mg component, a Ca component, a Ba component, and an Sr component. Among these components, the Mg component, the Ca component, and the Ba component are preferred. When the grain boundary phase has the crystal phase that contains at least the Si component and at least one of the group 2 element components, withstand voltage performance at a high temperature, for example about 900° C., is further improved. Since the crystal phase containing at least the Si component and at least one of the group 2 element components contains the Si component that is likely to form a glass phase after sintering, the ratio of the glass phase in the grain boundary phase is reduced to increase the ratio of the crystal phase. When the content of the crystal phase is greater than the content of the glass phase in the grain boundary phase, the conductive path caused by the glass phase softened at a higher temperature can be reduced more, whereby withstand voltage performance under a high temperature environment is improved. Examples of the crystal phase containing at least the Si component and at least one of the group 2 element components may include $(AE)_aSi_bO_c$, $(AE)_a(AE')_bSi_cO_d$, $(AE)_aAl_bSi_cO_d$, and $(AE)_a(AE')_bAl_cSi_dO_e$ (a, b, c, d, and e are integers). Specifically, the crystal phase may be $(AE)Al_2Si_2O_8$, $(AE)_2Al_2SiO_7$, or the like. The above "AE" represents any of the group 2 elements included in the periodic table defined by Recommendations 1990, IUPAC. The "AE" represents one element among the group 2 elements, and the above "AE'" represents a group 2 element different from the group 2 element represented by the "AE".

The grain boundary phase preferably has at least one of: a hexagonal-system crystal phase containing at least a Ba component and an Al component; and a crystal phase containing an Si component and at least one of the group 2 element components. More preferably, the grain boundary phase has both the crystal phases.

The above-mentioned crystal phases can be deposited by changing the raw material compositions in manufacturing the alumina sintered body, or the firing conditions in firing a molded body of raw material powders, such as the rate of temperature decrease.

The contents (mass % in terms of oxide) of the respective components contained in the alumina sintered body can be calculated on the basis of the results of fluorescent X-ray analysis or chemical analysis. Assuming that the contents of the detected Si component, Mg component, Ba component, and Ca component in terms of oxides are represented by $M_{SiO2}$, $M_{MgO}$, $M_{BaO}$, and $M_{CaO}$, respectively, and the sum of the contents is represented by Mt, the ratios of the respective contents to the sum Mt are calculated as $M_{SiO2}$/Mt, $M_{MgO}$/Mt, $M_{BaO}$/Mt, and $M_{CaO}$/Mt. Since most of each of the Si component, the Mg component, the Ba component, and the Ca component is contained in the grain boundary phase, the above ratios $M_{SiO2}$/Mt, $M_{MgO}$/Mt, $M_{BaO}$/Mt, and $M_{CaO}$/Mt can be regarded as the ratios in the grain boundary phase.

The types of the crystals contained in the grain boundary phase in the alumina sintered body can be confirmed by, for example, subjecting the alumina sintered body to X-ray diffraction analysis, and contrasting an X-ray diffraction chart obtained through the X-ray diffraction with a JCPDS card, for example.

The spark plug 1 is manufactured as follows, for example. First, a method of manufacturing the insulator 3, which is a feature of the present invention, will be described.

First, raw material powders, i.e., Al compound powder, Si compound powder, Mg compound powder, Ba compound powder, and Ca compound powder are blended at a predetermined ratio and mixed in a slurry. The mixing ratios of the respective powders can be set to be the same as, for example, the contents of the respective components in the alumina sintered body that forms the insulator 3. This mixing is preferably performed over 8 hours or more so that the raw material powders are uniformly mixed and the sintered body obtained is highly densified.

The Al compound powder is not particularly limited as long as the compound can be converted to an Al component by firing. Usually, alumina ($Al_2O_3$) powder is adopted. Since the Al compound powder sometimes contains unavoidable impurities such as Na or the like, high-purity Al compound powder is desirably adopted. For example, the purity of the Al compound powder is preferably 99.5% or more. In order to obtain a densified alumina sintered body, Al compound powder having an average grain size of 0.1 to 5.0 μm is preferably used.

The Si compound powder is not particularly limited as long as the compound can be converted to an Si component by firing. Examples thereof may include various inorganic powders such as oxide (including composite oxide), hydroxide, carbonate, chloride, sulfate, nitrate and phosphate of Si. Specific examples thereof may include $SiO_2$ powder. In the case where powder other than oxide is used as the Si compound powder, the used amount thereof is figured out by mass % in terms of oxide. The purity and the average grain size of the Si compound powder are fundamentally the same as those of the Al compound powder.

The Mg compound powder is not particularly limited as long as the compound can be converted to an Mg component by firing. Examples thereof may include various inorganic powders such as oxide (including composite oxide), hydroxide, carbonate, chloride, sulfate, nitrate and phosphate of Mg. Specific examples of the Mg compound powder may include MgO powder and $MgCO_3$ powder. In the case where powder other than oxide is used as the Mg compound powder, the used amount thereof is figured out by mass % in terms of oxide. The purity and the average grain size of the Mg compound powder are fundamentally the same as those of the Al compound powder.

The Ba compound powder is not particularly limited as long as the compound can be converted to a Ba component by firing. Examples thereof may include various inorganic powders such as oxide (including composite oxide), hydroxide, carbonate, chloride, sulfate, nitrate and phosphate of Ba. Specific examples of the Ba compound powder may include BaO powder and $BaCO_3$ powder. In the case where powder other than oxide is used as the Ba compound powder, the used amount thereof is figured out by mass % in terms of oxide. The purity and the average grain size of the Ba compound powder are fundamentally the same as those of the Al compound powder.

The Ca compound powder is not particularly limited as long as the compound can be converted to a Ca component by firing. Examples thereof may include various inorganic powders such as oxide (including composite oxide), hydroxide, carbonate, chloride, sulfate, nitrate and phosphate of Ca. Specific examples of the Ca compound powder may include CaO powder and $CaCO_3$ powder. In the case where powder other than oxide is used as the Ca compound powder, the used amount thereof is figured out by mass % in terms of oxide. The purity and the average grain size of the Ca compound powder are fundamentally the same as those of the Al compound powder.

The raw material powders are dispersed in the solvent and are mixed in the slurry with, for example, a hydrophilic binder being blended as a binder. Examples of the solvent adopted may include water and alcohol. Examples of the hydrophilic binder may include polyvinyl alcohol, water-soluble acrylic resin, gum arabic, and dextrin. These hydrophilic binders or solvents may be used singly or in combination of two or more species. Regarding the amounts of the hydrophilic binder and the solvent to be used, assuming that the raw material powder is 100 parts by mass, the hydrophilic binder is 0.1 to 5.0 parts by mass, preferably 0.5 to 3.0 parts by mass, and water used as the solvent is 40 to 120 parts by mass, preferably 50 to 100 parts by mass.

Subsequently, thus produced slurry is spray-dried through spray drying or the like and granulated so as to have the average grain size of 50 to 200 μm, preferably 70 to 150 μm. The average grain size is a value measured through a laser diffraction method (microtrac grain size distribution measuring apparatus (MT-3000), product of Nikkiso Co., Ltd.).

Subsequently, the granulated product is press-molded through, for example, rubber pressing or metal mold pressing, to yield an unfired molded body preferably having the shape and dimensions of the insulator 3. The outer surface of the obtained unfired molded body is polished by means of resinoid grind stone or the like, to work the unfired molded body into a desired shape.

The unfired molded body polished and finished into the desired shape is held and fired in air atmosphere at a predetermined temperature within a range of 1450 to 1700° C., preferably a range of 1550 to 1650° C., for 1 to 8 hours, preferably 3 to 7 hours, whereby the alumina sintered body is obtained. When the firing temperature of the alumina sintered body is 1450-1700° C., anomalous grain growth of the alumina component is less likely to occur, and the sintered body is likely to be sufficiently densified. Therefore, withstand voltage performance and mechanical strength of the obtained alumina sintered body can be ensured. Also, when the firing time is 1 to 8 hours, anomalous grain growth of the alumina component is less likely to occur, and the sintered body is likely to be sufficiently densified. Therefore, withstand voltage performance and mechanical strength of the obtained alumina sintered body can be ensured. When the temperature decrease rate is less than usual, for example, when the temperature decrease rate is not greater than 30° C./min, deposition of crystal phases is likely to occur in the grain boundary phase, thereby obtaining an alumina sintered body having withstand voltage performance at a high temperature, for example, about 900° C.

As described above, the insulator 3 formed from the alumina sintered body is obtained. The spark plug 1 including the insulator 3 is manufactured as follows, for example. That is, an electrode material such as an Ni alloy is worked to specific shape and dimensions to form the center electrode 4 and the ground electrode 8. Preparation and working of the electrode material may be performed sequentially. For example, a melt of an Ni alloy or the like having a desired composition is prepared by means of a vacuum melting furnace, and an ingot is prepared from the melt through vacuum casting. Then, the ingot is subjected to appropriate working processes such as hot working and wire drawing so as to have desired shape and dimensions, thereby producing the center electrode 4 and the ground electrode 8.

Subsequently, one end portion of the ground electrode 8 is joined, through electric resistance welding or the like, to the end surface of the metallic shell 7 formed through plastic working or the like to desired shape and dimensions. Then, the center electrode 4 is incorporated into the axial bore 2 of the insulator 3 through a known technique, and the axial bore 2 is filled with a composition for forming the connection portion 6 while preliminary compressing the composition. Subsequently, the composition is compressed and heated while the metal terminal 5 is pressed in through an end portion in the axial bore 2. Thus, the composition is sintered to form the connection portion 6. Subsequently, the insulator 3 to which the center electrode 4 and the like are fixed is assembled to the metallic shell 7 to which the ground electrode 8 is joined. Finally, a front end portion of the ground electrode 8 is bent toward the center electrode 4 such that one end of the ground electrode 8 is opposed to the front end portion of the center electrode 4, whereby the spark plug 1 is manufactured.

The spark plug 1 according to the present invention is used as an ignition plug for an internal combustion engine for an automobile, such as a gasoline engine. The spark plug 1 is fixed at a predetermined position by the screw portion 24 being screwed into a screw hole provided in a head (not shown) which defines a combustion chamber of the internal combustion engine. The spark plug 1 according to the present invention can be used for any internal combustion engine. The insulator 3 in the spark plug 1 according to the present invention has excellent withstand voltage performance even when a voltage is applied thereto under a high temperature environment of, for example, 900° C., and therefore is particularly suitable for an internal combustion engine in which the insulator 3 is exposed to a high temperature, for example, 900° C.

The spark plug 1 according to the present invention is not limited to the above-described embodiment, and various changes can be made as long as the purpose of the present invention can be accomplished.

EXAMPLES

Production of Insulator

Raw material powder was prepared by mixing $Al_2O_3$ powder, $SiO_2$ powder, $MgCO_3$ powder, $BaCO_3$ powder, and $CaCO_3$ powder, and $B_2O_3$ powder as desired. To this raw material powder, water serving as a solvent and a hydrophilic binder were added to prepare a slurry.

The prepared slurry was spray-dried through a spray drying method to granulate the slurry into powder having an average grain size of about 100 μm. This powder was press-molded and the outer surface of the molded body was ground by means of resinoid grind stone or the like to form an unfired molded body as a green compact of a test insulator 31. The unfired molded body was fired in air atmosphere at a firing temperature within a range of 1450 to 1700° C. for a firing time set within a range of 1 to 8 hours, and thereafter, the firing temperature was decreased to the room temperature at a temperature decrease rate of 30° C./min or lower. Thus, the test insulator 31 with a lid, having a shape shown in FIG. 2, was obtained.

Measurement of Composition and the Like of Test Insulator

Regarding the composition of the produced test insulator, the contents (mass % in terms of oxide) of the respective components were calculated by fluorescent X-ray analysis or chemical analysis. Subsequently, assuming that the contents of an Si component, an Mg component, a Ba component, and a Ca component in terms of oxides are represented by $M_{SiO2}$, $M_{MgO}$, $M_{BaO}$, and $M_{CaO}$, respectively, and the sum of the contents is represented by Mt, the ratios of the respective contents to the sum Mt were calculated as $M_{SiO2}$/Mt, $M_{MgO}$/Mt, $M_{BaO}$/Mt, and $M_{CaO}$/Mt. It is noted that the mixing ratio in the raw material powder (raw material powder composition) almost agreed with the content (mass % in terms of oxides) of each component calculated by subjecting the alumina sintered body to fluorescent X-ray analysis or chemical analysis.

Subsequently, the test insulator 31 was subjected to X-ray diffraction analysis to identify the crystal phase in the grain boundary phase.

the furnace, and heated by the heater 52 until the temperature in the furnace reached 900° C. Then, a voltage was applied between the test center electrode 41 and the annular member 51 at a voltage increase rate of 1.5 kV/s, with the temperature in the furnace being kept at 900° C. A voltage value was measured when dielectric breakdown occurred in the test insulator 31, that is, when the test insulator 31 was perforated and the voltage was not further increased. Subsequently, the thickness of the test insulator 31 was measured at the portion in which the test insulator 31 was perforated from the outer peripheral surface thereof to the axial bore 21. A value obtained by dividing the voltage value by the thickness is shown in Table 1 as a withstand voltage value (kV/mm).

TABLE 1

| Test | Alumina sintered body | | | | | | | | | | Type of crystal phase in grain | Evaluation result Withstand voltage |
|---|---|---|---|---|---|---|---|---|---|---|---|---|
| | mass % in terms of oxide | | | | | | | | | | boundary | value |
| No. | $Al_2O_3$ | $SiO_2$ | MgO | BaO | CaO | $B_2O_3$ | $M_{SiO2}$/Mt | $M_{MgO}$/Mt | $M_{BaO}$/Mt | $M_{CaO}$/Mt | phase(*) | (kV/mm) |
| 1 | 99.00 | 2.42 | 0.26 | 1.46 | 0.97 | 0.00 | 0.47 | 0.05 | 0.29 | 0.196 | BS | 49 |
| 2 | 98.00 | 1.50 | 0.16 | 4.34 | 0.58 | 0.00 | 0.23 | 0.02 | 0.66 | 0.09 | BCX | 56 |
| 3 | 97.00 | 2.22 | 0.04 | 2.95 | 0.58 | 0.00 | 0.38 | 0.007 | 0.51 | 0.10 | BCX | 53 |
| 4 | 96.00 | 2.23 | 0.14 | 2.36 | 0.79 | 0.00 | 0.40 | 0.03 | 0.43 | 0.14 | CX | 54 |
| 5 | 95.00 | 2.27 | 0.13 | 1.91 | 1.01 | 0.00 | 0.43 | 0.02 | 0.36 | 0.19 | BX | 54 |
| 6 | 94.00 | 2.35 | 0.28 | 2.35 | 0.52 | 0.00 | 0.43 | 0.05 | 0.43 | 0.09 | CXSA | 52 |
| 7 | 93.00 | 1.79 | 0.14 | 2.97 | 0.99 | 0.00 | 0.30 | 0.02 | 0.50 | 0.17 | BXG | 54 |
| 8 | 92.00 | 2.14 | 0.14 | 3.43 | 0.29 | 0.00 | 0.36 | 0.02 | 0.57 | 0.05 | BCX | 56 |
| 9 | 91.00 | 2.18 | 0.14 | 2.89 | 0.55 | 0.00 | 0.38 | 0.02 | 0.50 | 0.10 | BCX | 57 |
| 10 | 90.00 | 1.93 | 0.13 | 3.83 | 0.32 | 0.00 | 0.31 | 0.02 | 0.62 | 0.05 | BCX | 57 |
| 11 | 89.00 | 2.50 | 0.16 | 4.00 | 0.33 | 0.00 | 0.36 | 0.02 | 0.57 | 0.05 | BCX | 56 |
| 12 | 88.00 | 1.93 | 0.13 | 3.83 | 0.32 | 0.00 | 0.31 | 0.02 | 0.62 | 0.05 | BCX | 57 |
| 13 | 87.00 | 1.70 | 0.14 | 3.94 | 0.53 | 0.00 | 0.27 | 0.02 | 0.62 | 0.08 | BCX | 58 |
| 14 | 93.15 | 1.24 | 0.13 | 4.95 | 0.52 | 0.00 | 0.18 | 0.02 | 0.72 | 0.08 | BX | 52 |
| 15 | 93.73 | 1.77 | 0.41 | 3.82 | 0.27 | 0.00 | 0.28 | 0.07 | 0.61 | 0.04 | BX | 51 |
| 16 | 92.93 | 1.21 | 0.13 | 5.46 | 0.27 | 0.00 | 0.17 | 0.018 | 0.77 | 0.04 | BX | 52 |
| 17 | 92.97 | 1.28 | 0.12 | 5.43 | 0.20 | 0.00 | 0.18 | 0.017 | 0.77 | 0.03 | BX | 53 |
| 18 | 94.25 | 2.29 | 0.03 | 2.92 | 0.51 | 0.00 | 0.40 | 0.005 | 0.51 | 0.09 | BCX | 54 |
| 19 | 81.00 | 2.42 | 0.11 | 0.34 | 1.75 | 0.00 | 0.52 | 0.02 | 0.07 | 0.38 | H | 43 |
| 20 | 80.00 | 2.96 | 0.84 | 0.79 | 0.15 | 0.00 | 0.62 | 0.18 | 0.17 | 0.03 | S | 20 |
| 21 | 79.00 | 2.01 | 0.00 | 3.43 | 0.57 | 0.00 | 0.33 | 0.00 | 0.57 | 0.09 | CX | 26 |
| 22 | 78.00 | 2.26 | 0.30 | 3.40 | 0.10 | 0.00 | 0.37 | 0.05 | 0.56 | 0.02 | CX | 12 |
| 23 | 77.00 | 1.00 | 0.14 | 5.00 | 0.30 | 0.00 | 0.16 | 0.02 | 0.78 | 0.05 | BCX | 11 |
| 24 | 94.46 | 2.62 | 0.51 | 1.44 | 0.48 | 0.50 | 0.52 | 0.10 | 0.29 | 0.09 | CSA | 8 |

Figure 2:
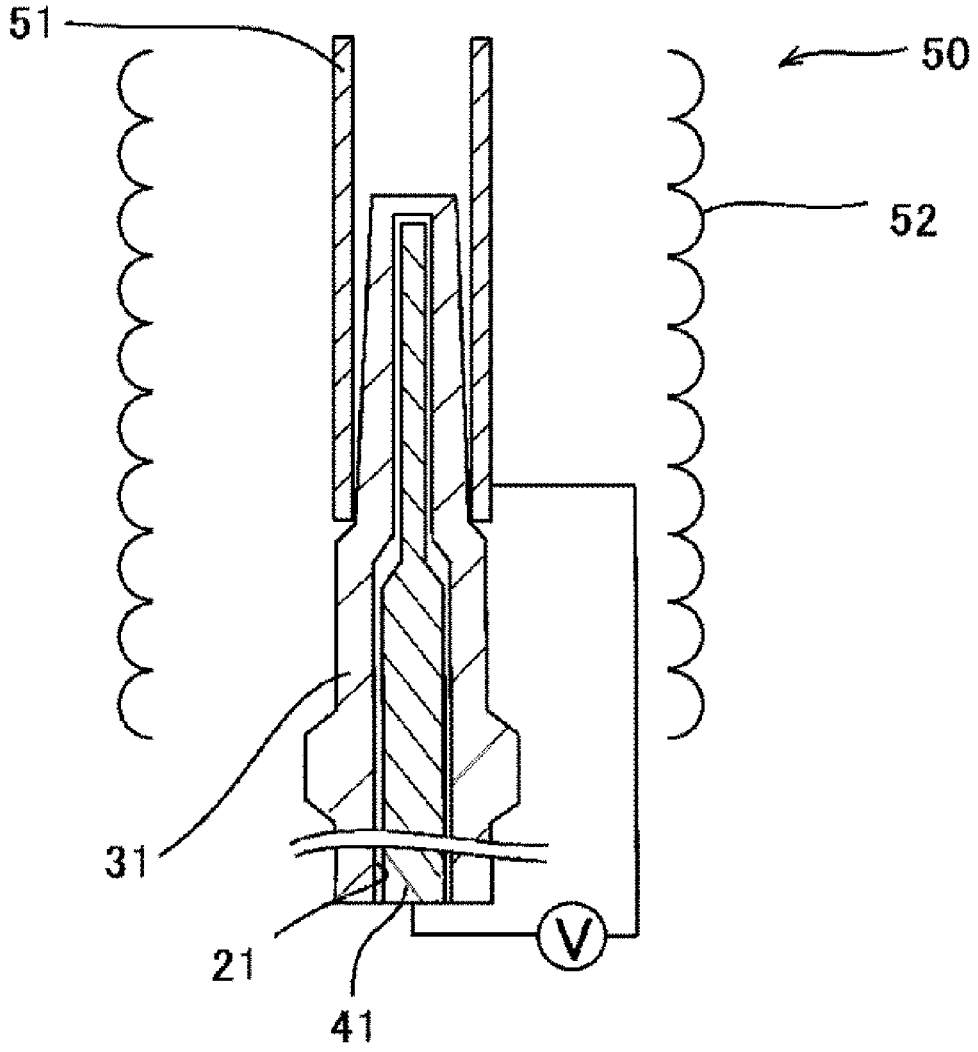
FIG. 2 is a cross-sectional explanatory view schematically showing a withstand voltage measuring apparatus used for a high-temperature withstand voltage test.

(*)S: $MgAl_2O_4$ A: $CaSi_2Al_2O_8$ C: $BaAl_2Si_2O_8$ (low temperature phase) B: $BaAl_2Si_2O_8$ (high temperature phase) X: $BaMgAl_{10}O_{17}$ G: $Ca_2Al_2SiO_7$ H: $CaAl_{12}O_{19}$ High-Temperature Withstand Voltage Test By using a withstand voltage measuring apparatus 50 shown in FIG. 2, the test insulator 31 was subjected to a high-temperature withstand voltage test at 900° C. As shown in FIG. 2, the produced test insulator 31 has an axial bore 21 in the center thereof along the axial direction, and a lid is provided at the front end portion of the axial bore 21, whereby the axial bore 21 is closed. The withstand voltage measuring apparatus 50 includes a metallic annular member 51, and a furnace having a heater 52 for heating the test insulator 31. A test center electrode 41 made of an Ni alloy was inserted into the axial bore 21 of the test insulator 31 to reach the front end portion of the axial bore 21. The annular member 51 was disposed such that the inner peripheral surface of the annular member 51 is in contact with the outer peripheral surface of the test insulator 31 at a position in front of a portion of the test insulator 31, the outer diameter of which increases from the front end to the rear end. In this state, the withstand voltage of the test insulator 31 was measured. Specifically, first, the test insulator 31 was put in As shown in Table 1, the insulators of the test Nos. 19 to 24 in which at least one of $M_{SiO2}$/Mt, $M_{MgO}$/Mt, $M_{BaO}$/Mt, and $M_{CaO}$/Mt is outside the range of the present invention, have the withstand voltage values not greater than "43", which means that sufficient withstand voltage performance is not obtained. On the other hand, the insulators of the test Nos. 1 to 18 in which the values of the Al component content, $M_{SiO2}$/Mt, $M_{MgO}$/Mt, $M_{BaO}$/Mt, and $M_{CaO}$/Mt are within the ranges of the present invention, have the withstand voltage values not less than "49", which means that sufficient withstand voltage performance is obtained. In addition, each of the insulators of the test Nos. 1 to 18 contains at least one of: a hexagonal-system crystal phase X containing a Ba component and an Al component; and crystal phases A, C, B, and G containing a group 2 element and an Si component.

When the test No. 1 is compared with the test Nos. 2 to 18, the insulator of the test No. 1 which contains only the crystal phase B among the crystal phases X, A, C, B, and G, has the withstand voltage value of "49". On the other hand, the insulators of the test Nos. 2 to 18 each containing at least the crystal phase X and containing two or more crystal phases among the crystal phases X, A, C, B, and G, have the withstand voltage values not less than "51". Thus, the insulators of the test Nos. 2 to 18 are superior in withstand voltage performance to the insulator of the test No. 1.

When the test No. 24 is compared with the test Nos. 1 to 23, the withstand voltage value of the insulator of the test No. 24 which contains the B component is "8", while the withstand voltage values of the insulators of the test Nos. 1 to 23 containing no B component are not less than "11". Thus, the insulator of the test No. 24 is inferior in withstand voltage performance to the insulators of the test Nos. 1 to 23.

DESCRIPTION OF REFERENCE NUMERALS

1 spark plug
2 axial bore
3 insulator
4 center electrode
5 metal terminal
6 connection portion
7 metallic shell
8 ground electrode
11 rear trunk portion
12 large diameter portion
13 front trunk portion
14 leg portion
24 screw portion
25 gas seal portion
26 tool engagement portion
27 crimping portion
28 rear end portion
29 rod-shaped portion
31 test insulator
21 axial bore
41 test center electrode
50 withstand voltage measuring apparatus
51 annular member
52 heater
G spark discharge gap Having described the invention, the following is claimed:

1. A spark plug including an insulator containing not less than 92 mass % and not greater than 96 mass % of Al component in terms of oxide, wherein the insulator is formed from an alumina sintered body comprising an alumina crystal and a grain boundary phase present between crystal grains of the alumina crystal, and assuming that mass contents of Si component, Mg component, Ba component, and Ca component in terms of oxide are represented by $M_{SiO2}$, $M_{MgO}$, $M_{BaO}$, and $M_{CaO}$, respectively, and a sum of $M_{SiO2}$, $M_{MgO}$, $M_{BaO}$, and $M_{CaO}$ is represented by Mt, the grain boundary phase contains the Si component, the Mg component, the Ba component, and the Ca component so as to satisfy conditions (1) to (4) as follows:

$$0.17 \leq M_{SiO2}/Mt \leq 0.47 \quad (1)$$

$$0.005 \leq M_{MgO}/Mt \leq 0.07 \quad (2)$$

$$0.29 \leq M_{BaO}/Mt \leq 0.77 \quad (3)$$

$$0.03 \leq M_{CaO}/Mt \leq 0.19 \quad (4).$$

2. The spark plug according to claim 1, wherein the grain boundary phase has a hexagonal-system crystal phase that contains at least the Ba component and the Al component.

3. The spark plug according to claim 1, wherein the grain boundary phase has a crystal phase that contains the Si component and at least one of components of group 2 elements included in a periodic table defined by Recommendations 1990, IUPAC.

4. The spark plug according to claim 2, wherein the grain boundary phase has a crystal phase that contains the Si component and at least one of components group 2 elements included in a periodic table defined by Recommendations 1990, IUPAC.

* * * * *